United States Patent [19]

Childs

[11] Patent Number: 4,702,179

[45] Date of Patent: Oct. 27, 1987

[54] CONTROLLED COAL BURNING AND HEAT COLLECTING METHOD AND APPARATUS

[75] Inventor: Henry T. Childs, Chattanooga, Tenn.

[73] Assignee: Temperature Adjusters, Inc., Chattanooga, Tenn.

[21] Appl. No.: 601,655

[22] Filed: Apr. 18, 1984

[51] Int. Cl.[4] ..... F23J 15/00

[52] U.S. Cl. ..... 110/215; 110/216; 110/251; 110/254; 122/20 B

[58] Field of Search ..... 110/346, 347, 101 CA, 110/110, 162, 248, 251, 254, 259, 215, 216

[56] References Cited

U.S. PATENT DOCUMENTS

| | | | |
|---|---|---|---|
| 1,291,175 | 1/1919 | Sargent et al. | 110/215 |
| 2,171,535 | 9/1939 | Berg et al. | 110/254 |
| 3,572,264 | 3/1971 | Mercer | 110/215 |
| 3,745,939 | 7/1973 | Allbritton | 110/215 |
| 3,916,991 | 11/1975 | Trump | 122/20 B |
| 3,995,567 | 12/1976 | Drake et al. | 110/216 |
| 4,103,735 | 8/1978 | Warner | 122/20 B |
| 4,167,146 | 9/1978 | Wirth | 110/251 |
| 4,213,404 | 7/1980 | Spaulding | 110/254 |
| 4,395,956 | 8/1983 | Hand, Jr. et al. | 110/254 |
| 4,441,922 | 4/1984 | Most et al. | 110/254 |

*Primary Examiner*—Henry C. Yuen

[57] ABSTRACT

This invention relates to a method and apparatus for controlling the burn of coal, or fuel to produce the desired output of heat ranging from under 10,000 BTU per hour to over 150,000 BTU per hour, and the collection of said heat. It depends on the sizing of the grate, firebox and combustion area to produce the desired burn, the vertical exhaust pipes and soot and ash traps for self-cleaning and storing waste, the automatic controls for self-maintenance, the air washing system for cleaning the exhaust air of pollutants, the water heating coils and tanks for storing the produced heat, the chimney insulated compartments with gravel for accelerating heat absorption, and its own chimney that makes it a self-contained unit that can be located for use inside or outside of most any selected existing house or building.

6 Claims, 20 Drawing Figures

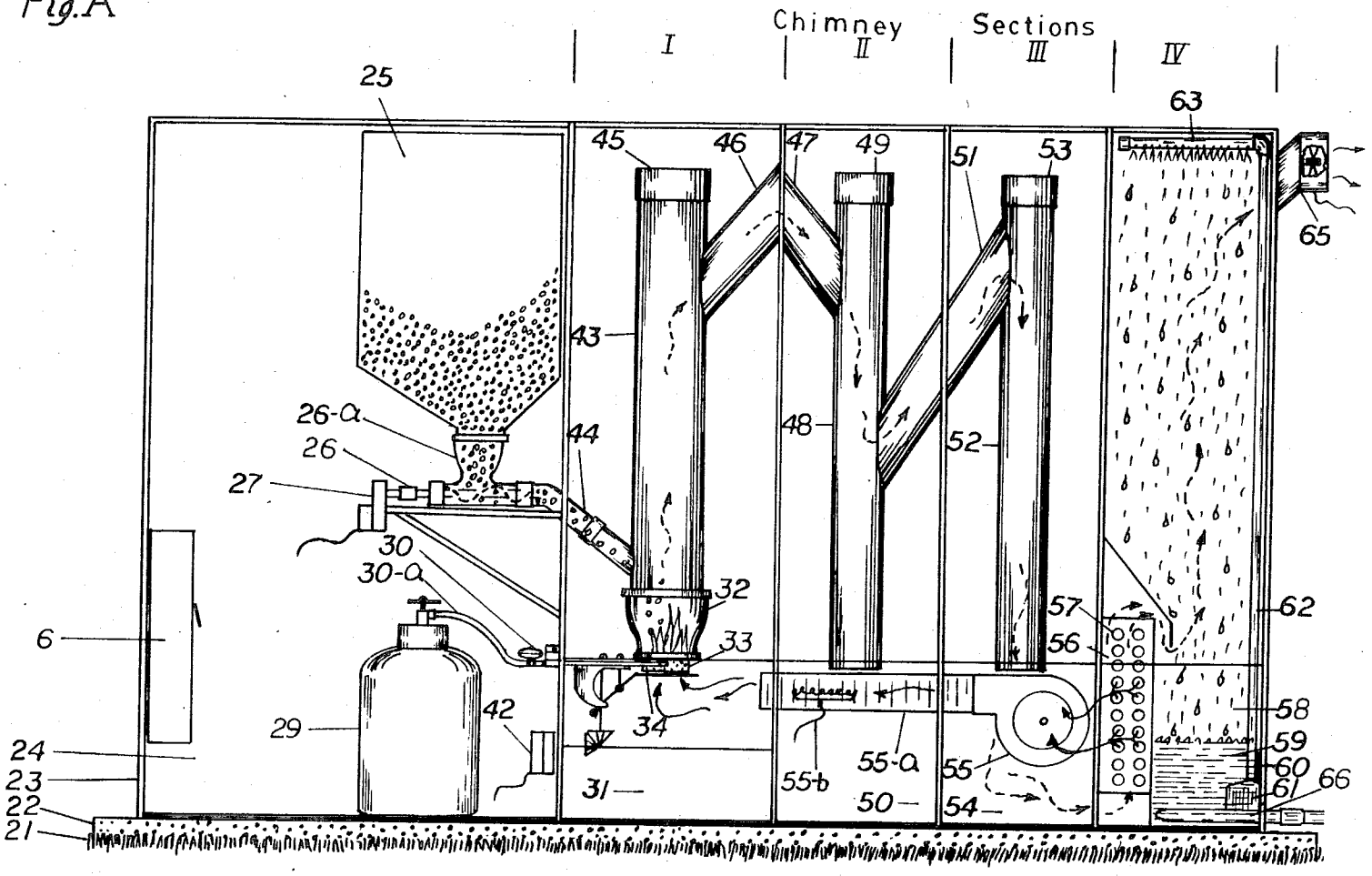
Fig. A

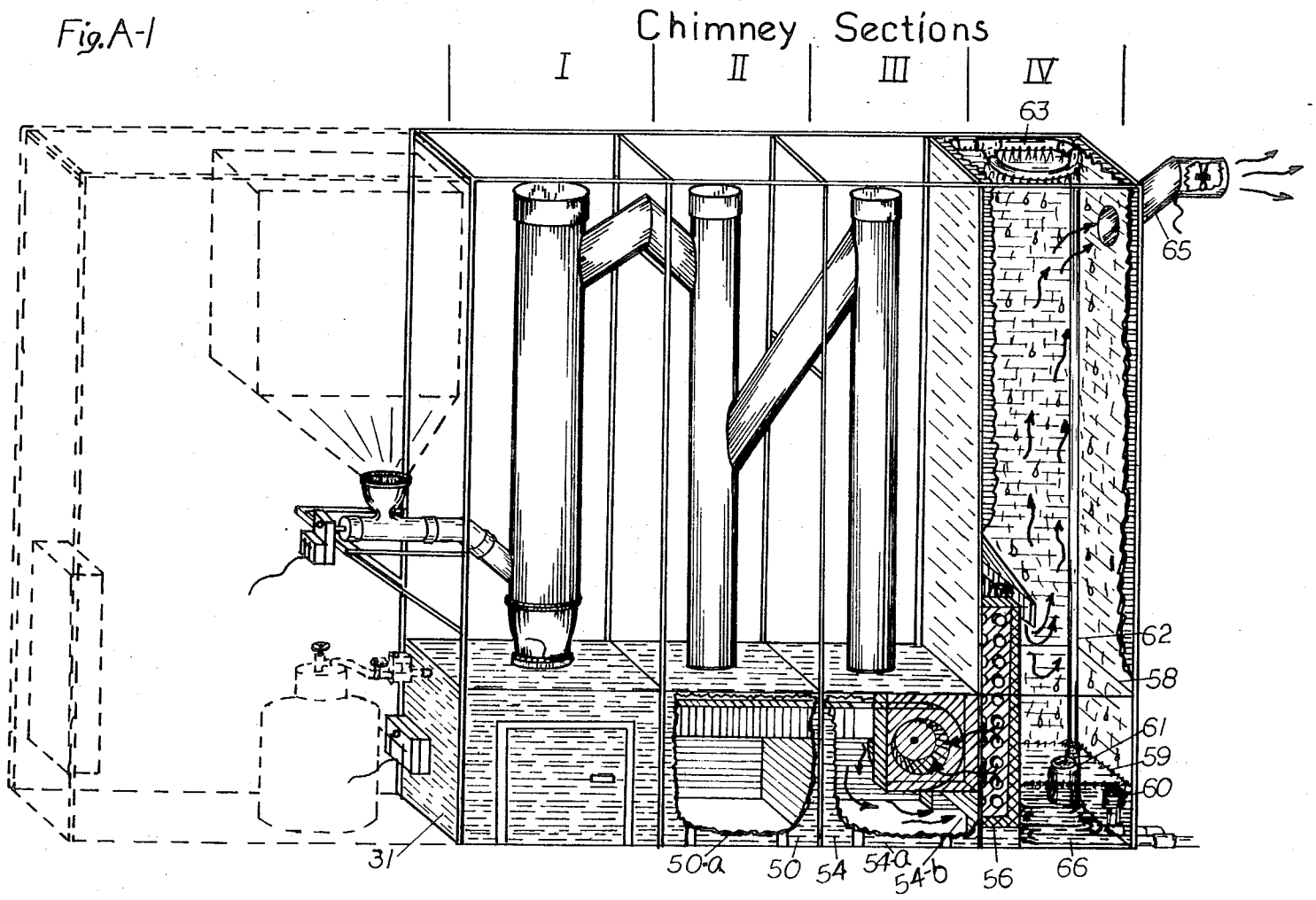
Fig. A-1

Fig. A-2-a
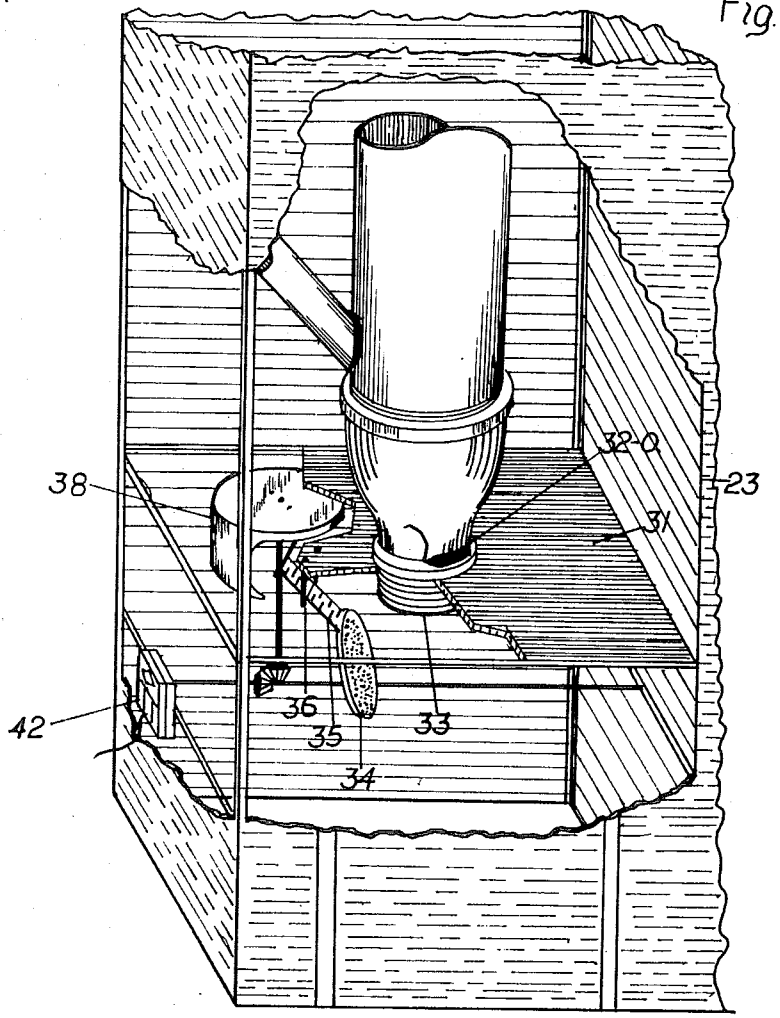
Fig. A-2
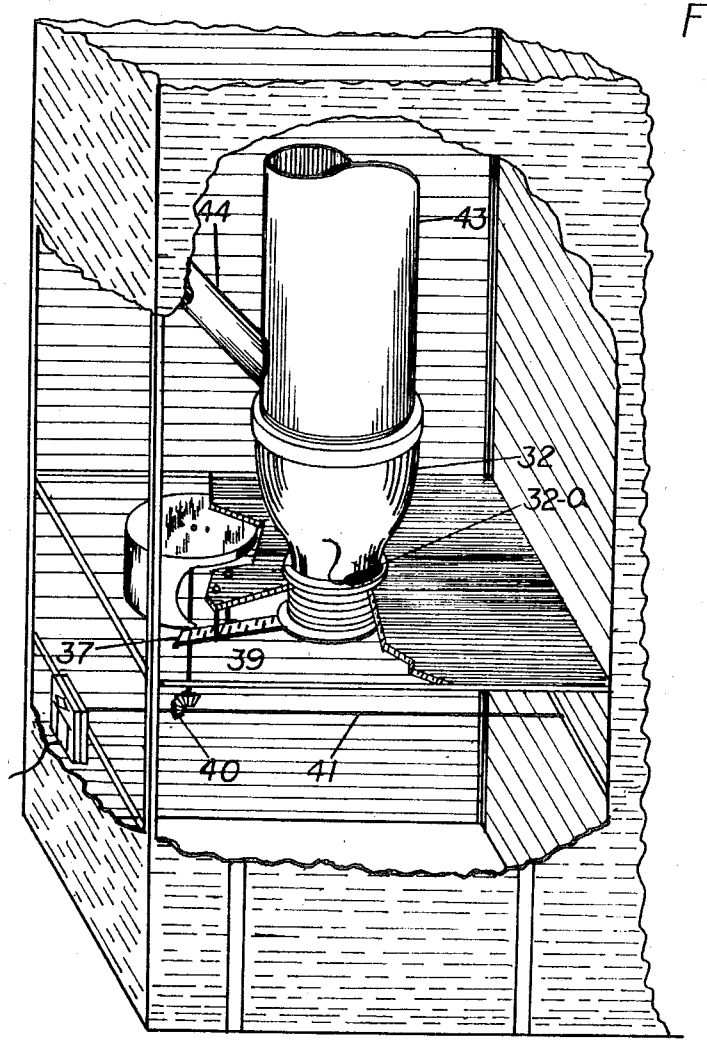

Fig. A-3a
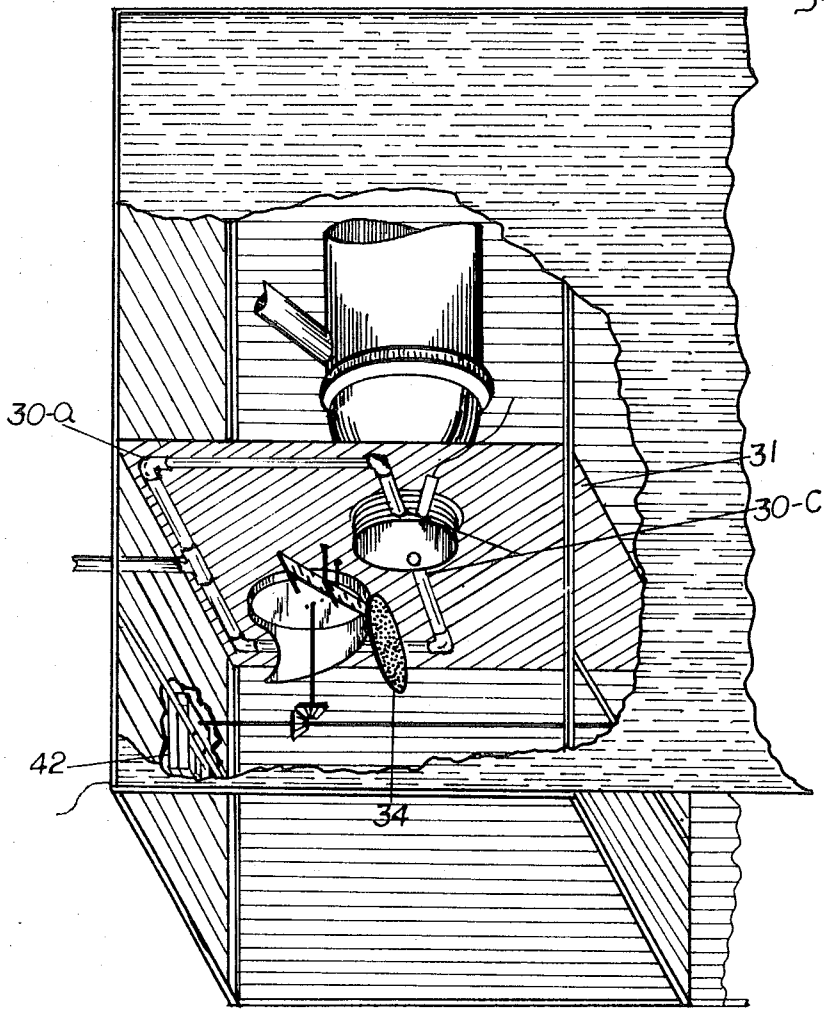
Fig. A-3
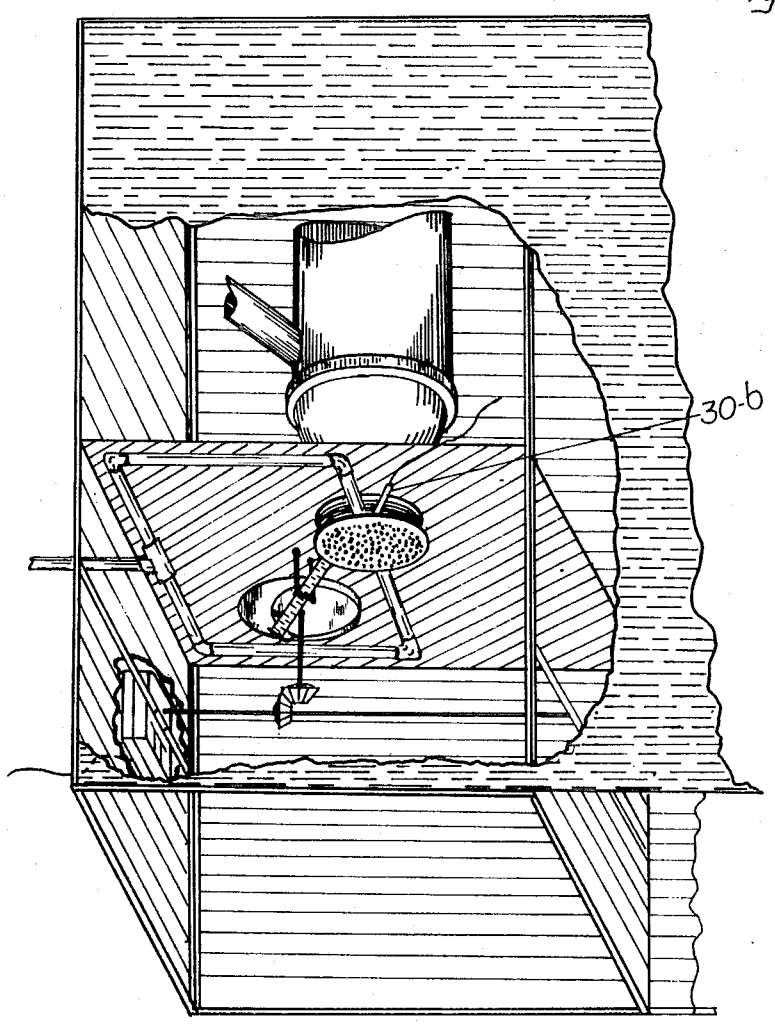

Fig. A-4-b
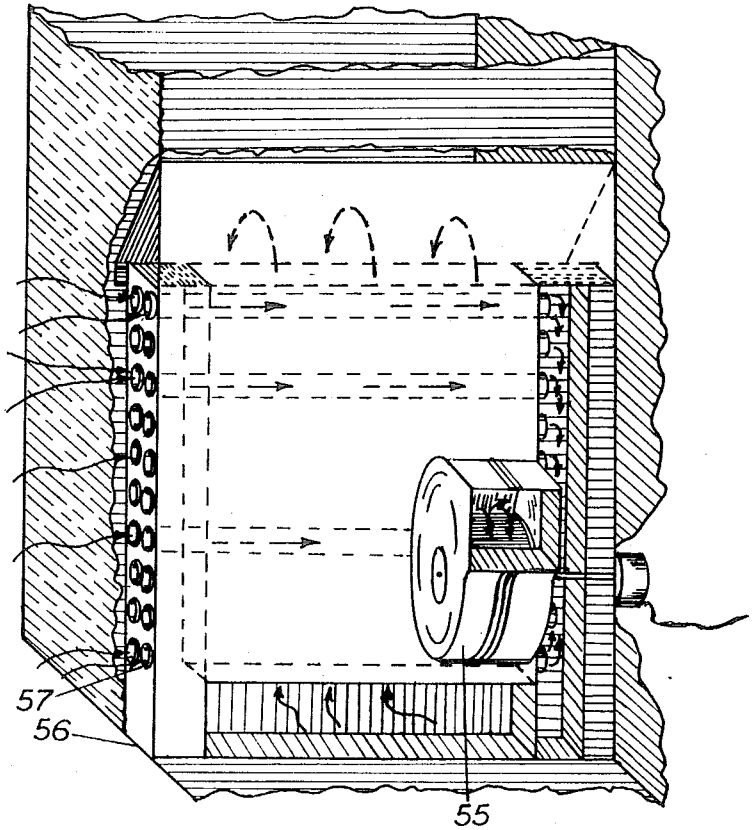
Fig. A-4
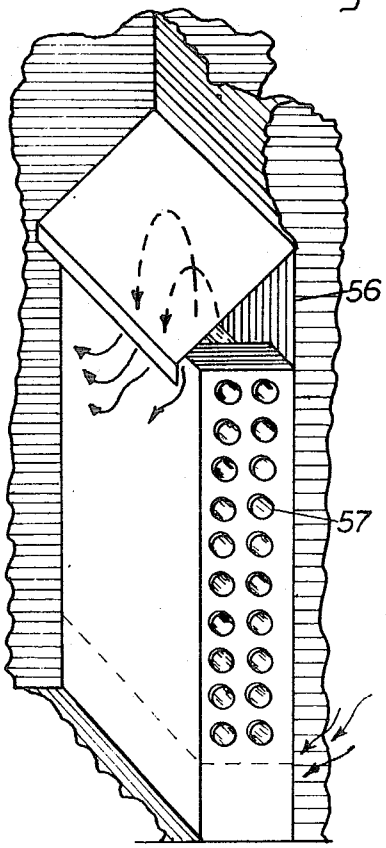
Fig. A-4-a
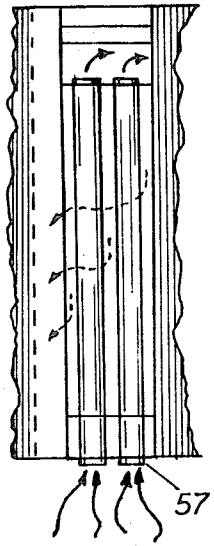

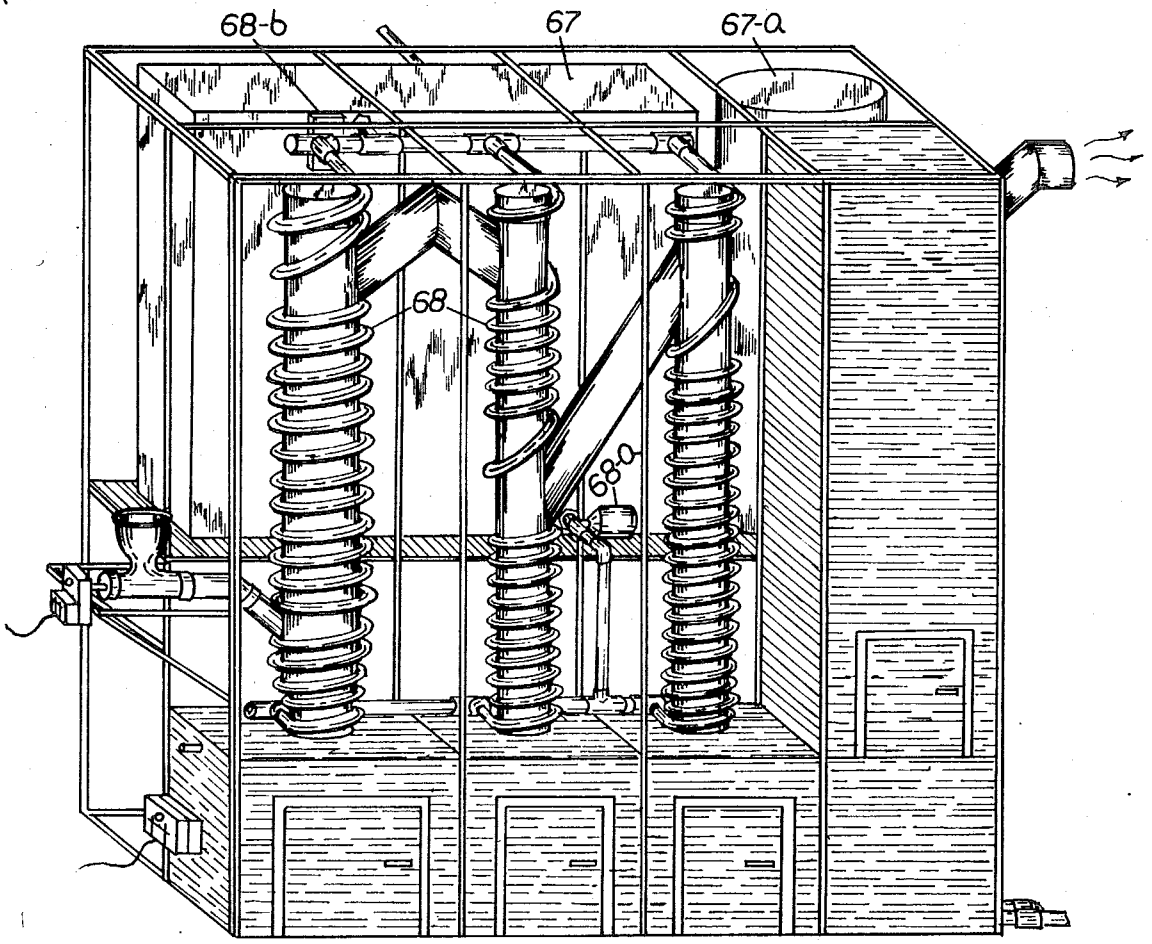
Fig. A-5

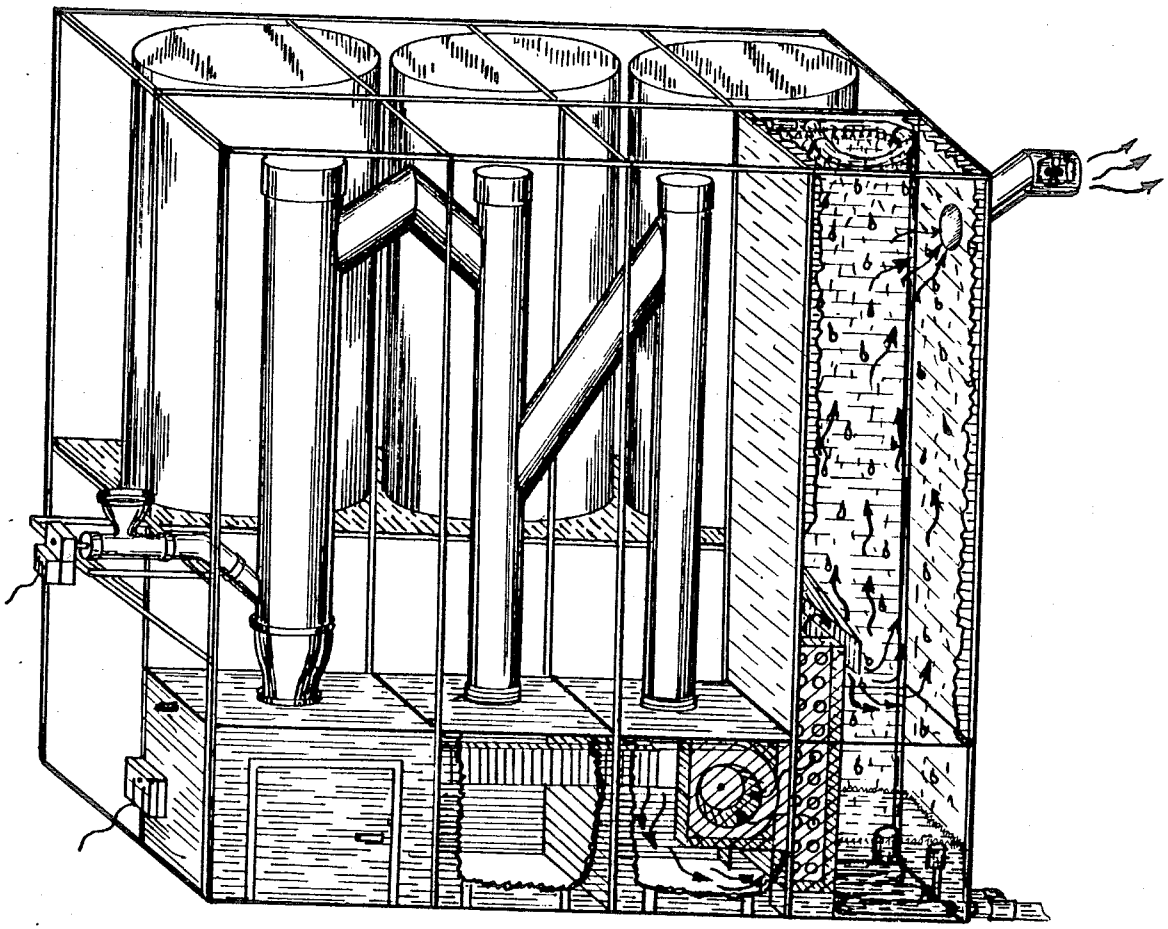
Fig. A-5-1

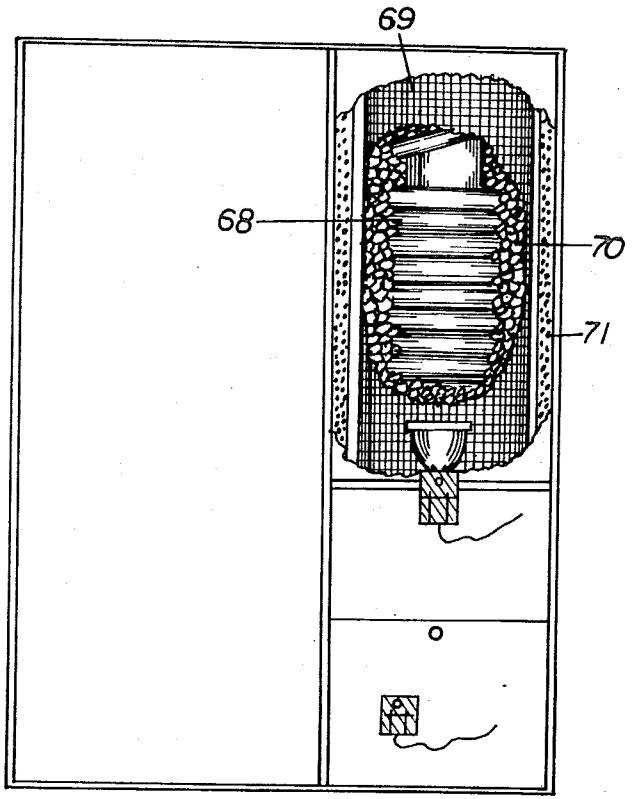
Fig. A-7
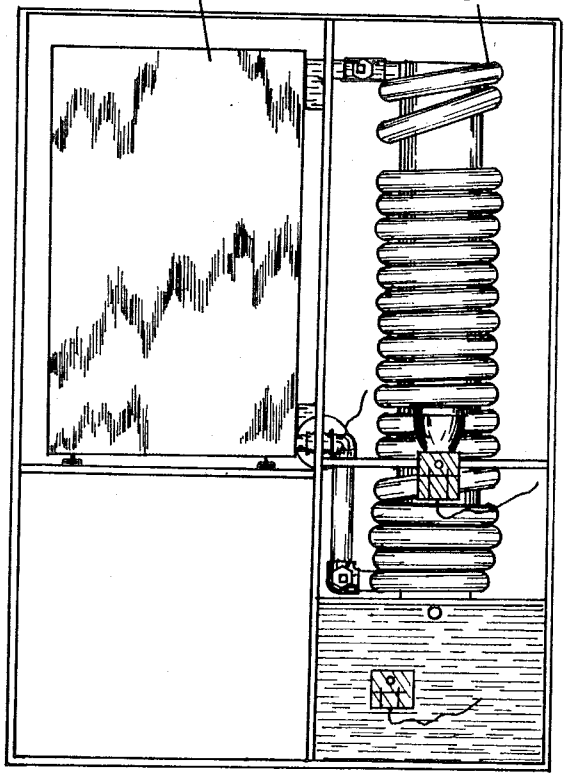
Fig. A-6

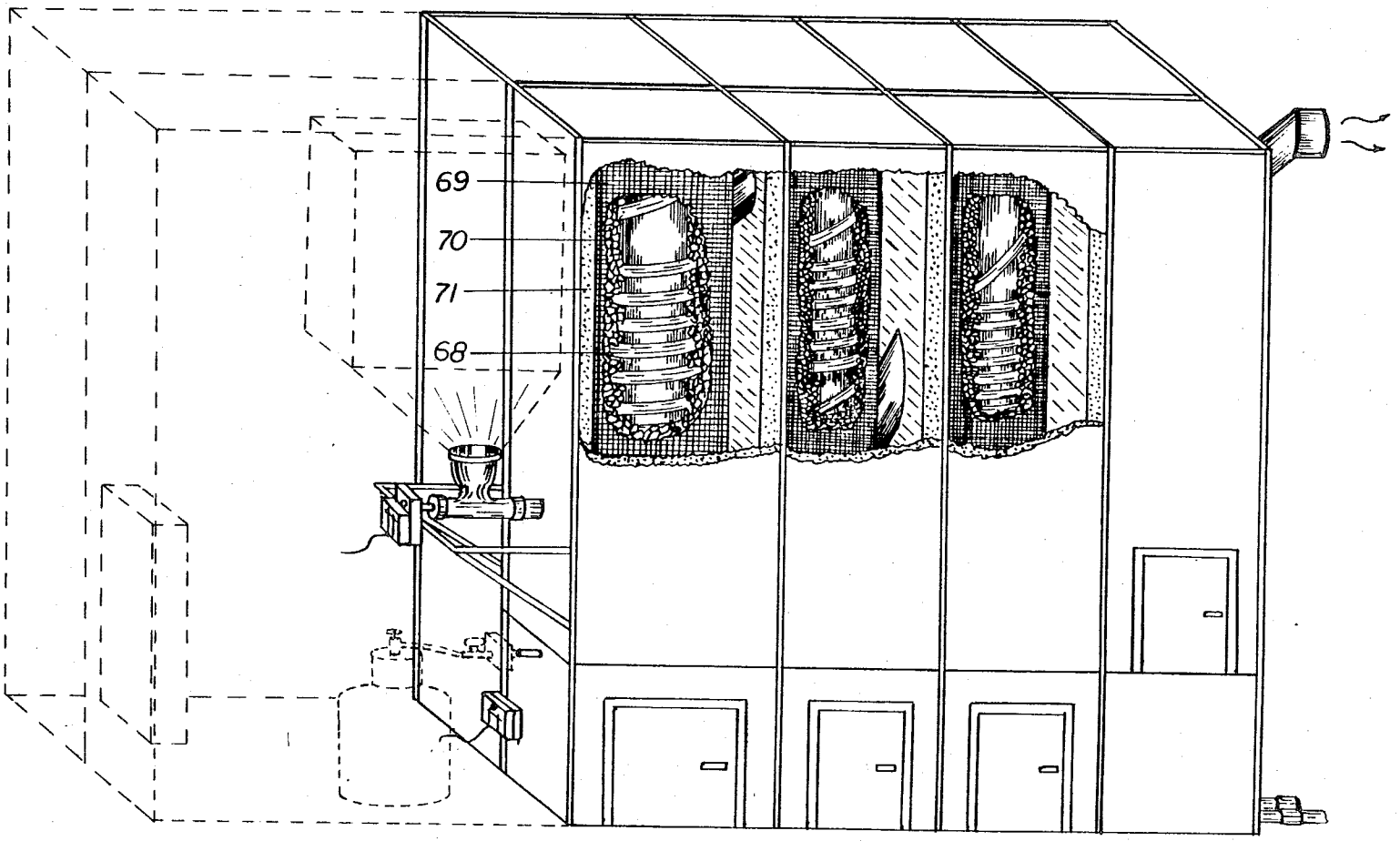
Fig. A-8

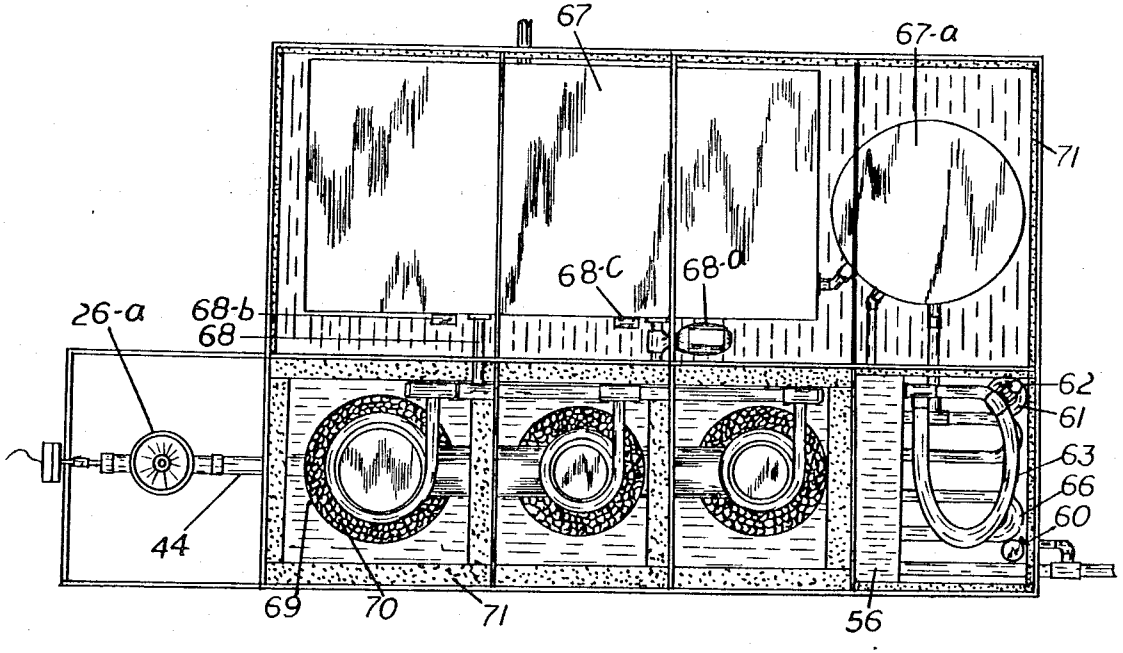
Fig. A-9

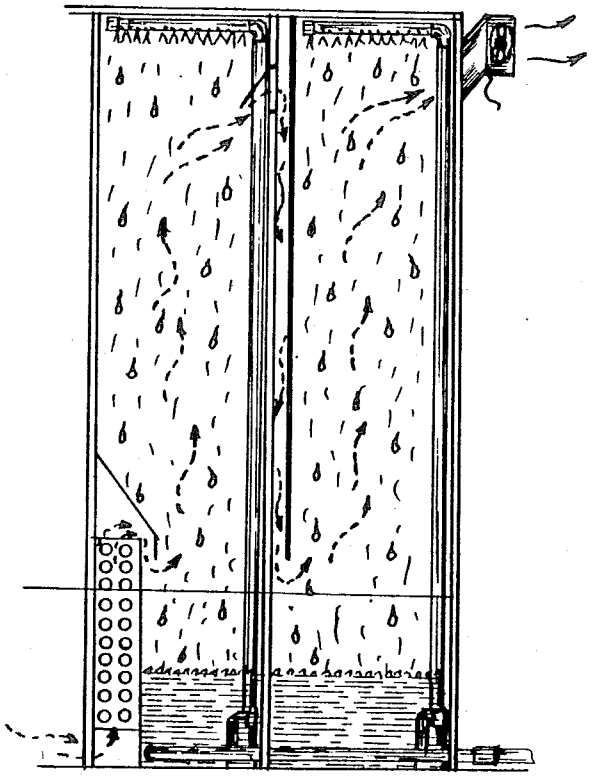
Fig. A-11
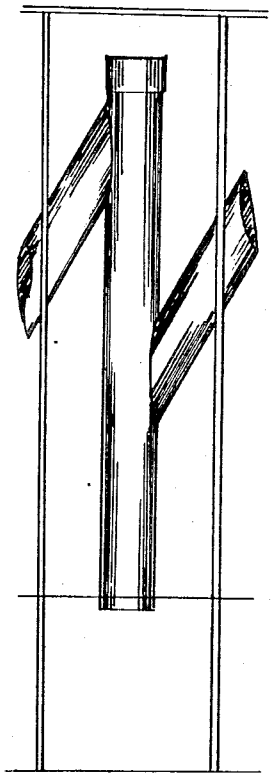
Fig. A-10

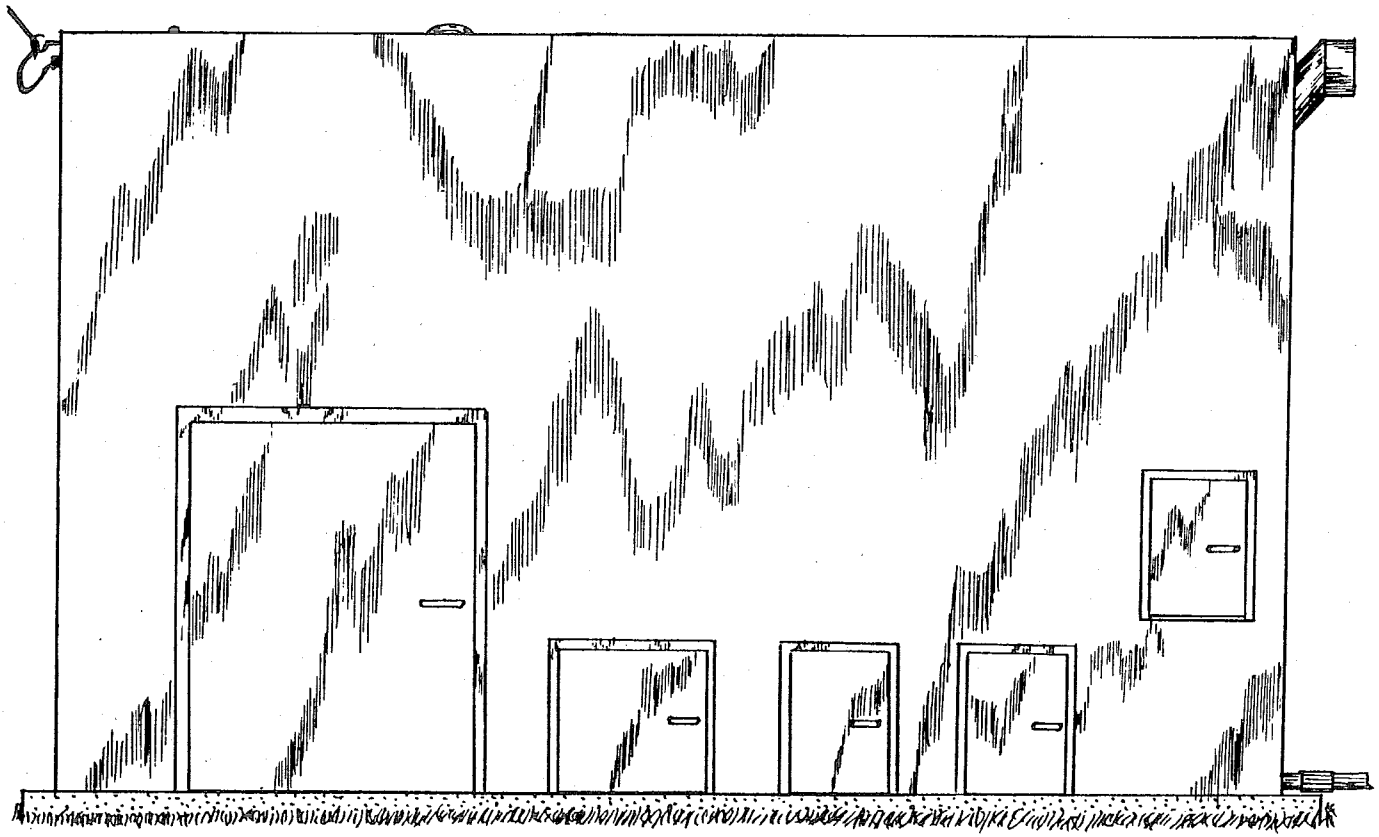
Fig. A-12

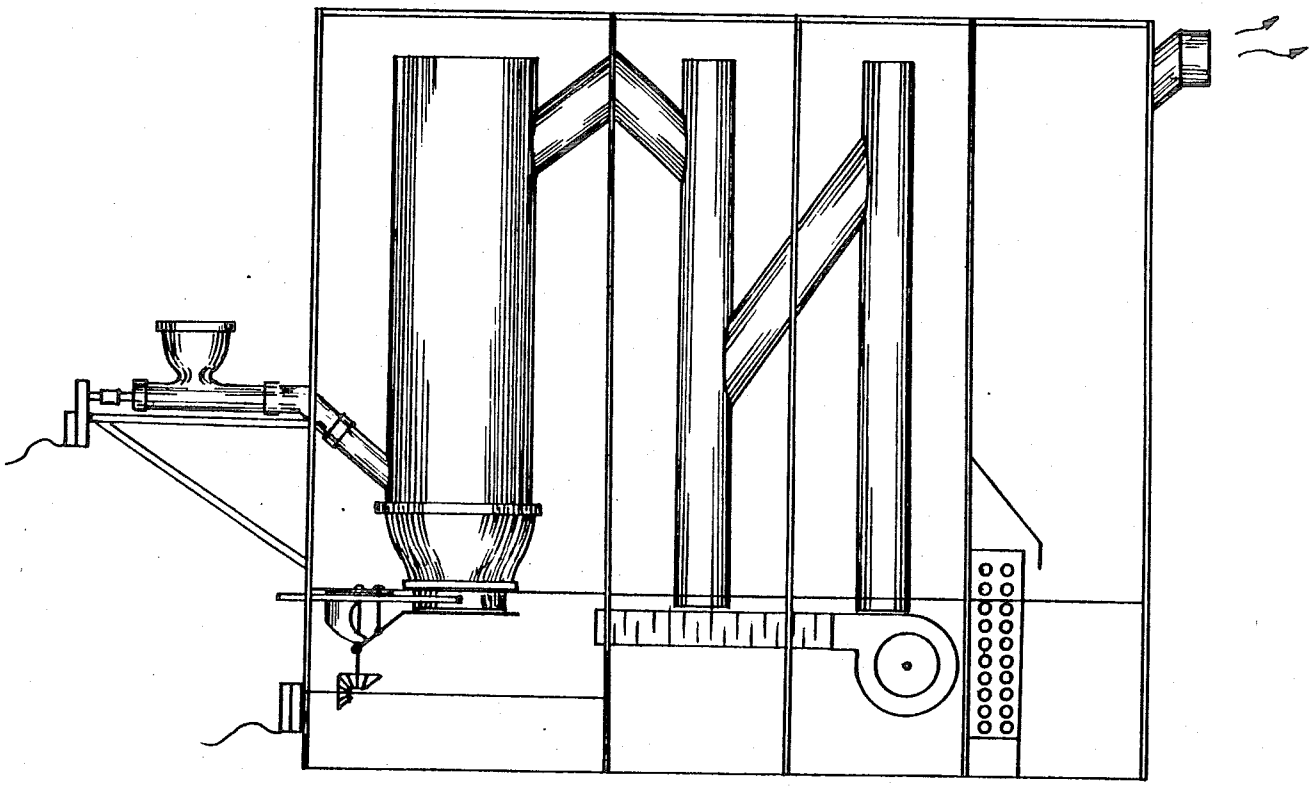
Fig. C

[Fig. D]
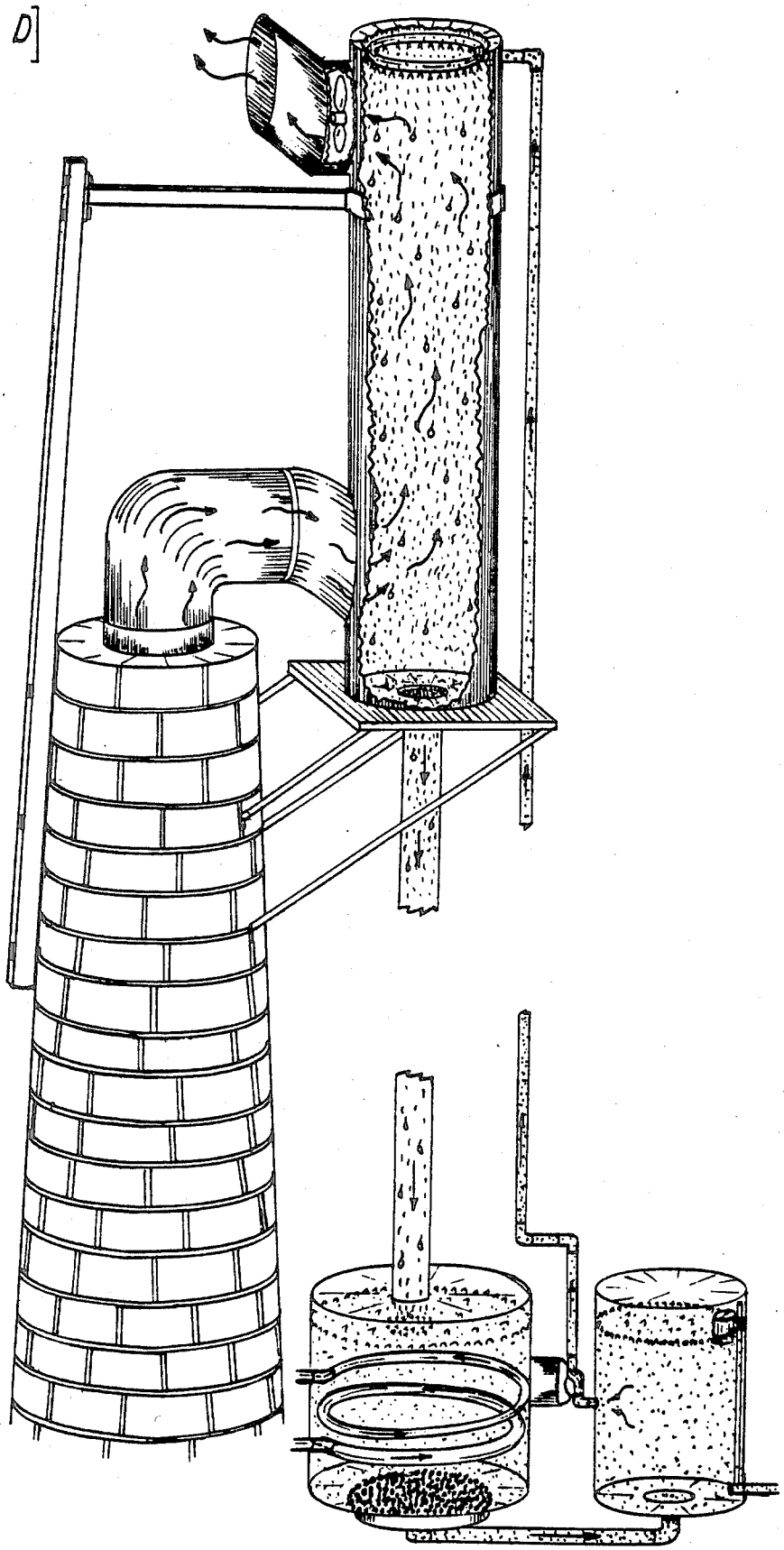

[Fig. E]
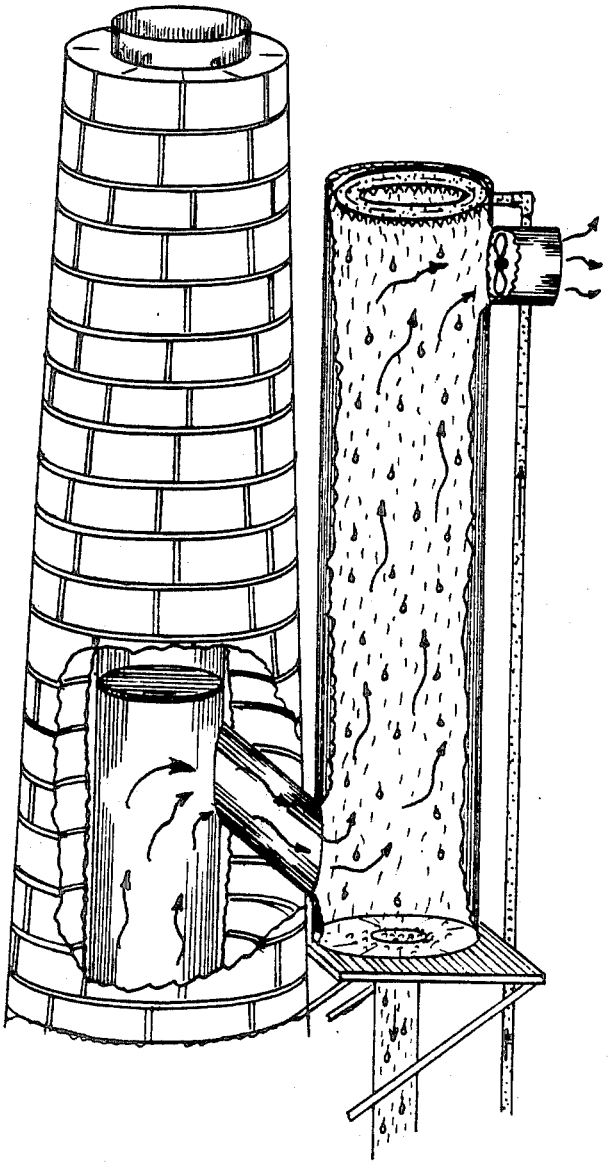
[Fig. F]
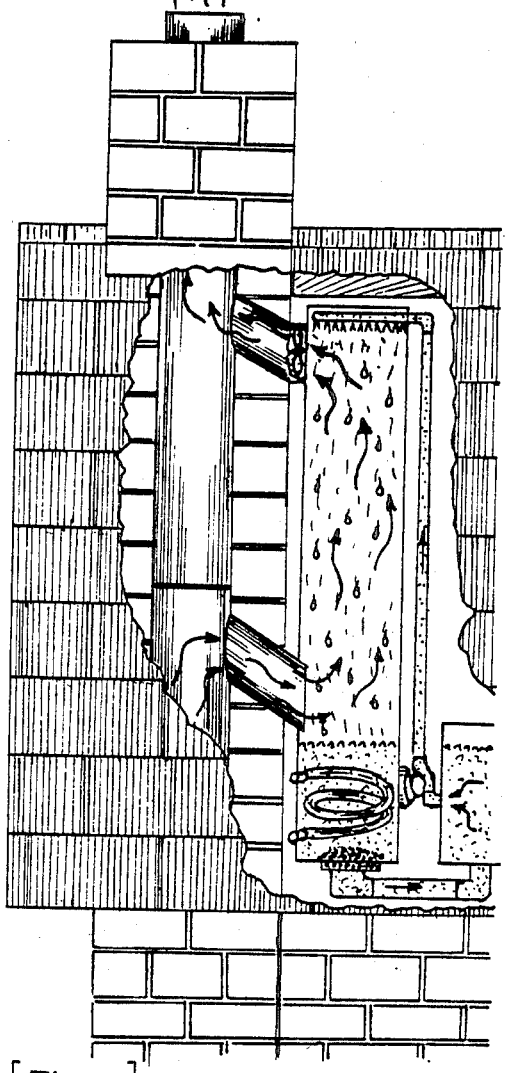
[Fig. G]
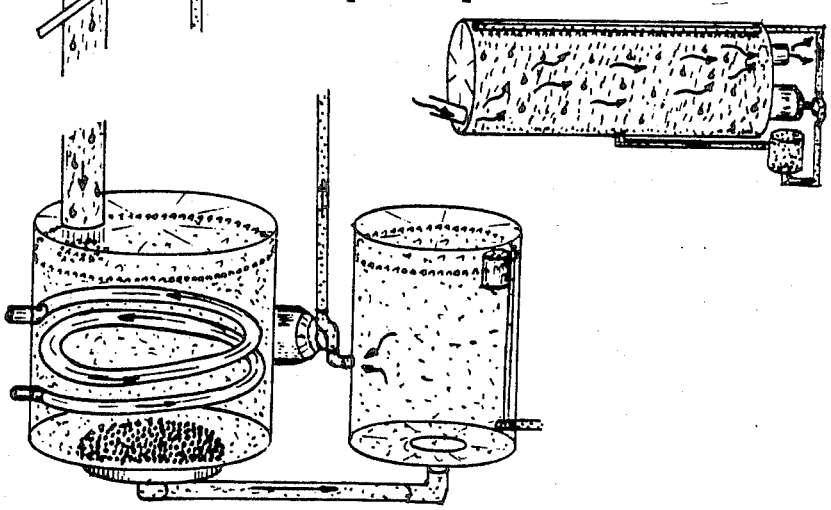

CONTROLLED COAL BURNING AND HEAT COLLECTING METHOD AND APPARATUS

BACKGROUND OF THE INVENTION

The present availability of small coal fired heating plants in the range of 10,000 BTU per hour to 150,000 BTU per hour of heat is limited. The ones that are available are usually low in efficiency, require indoor locations such as basements, large utility rooms, or are individual room heaters, require chimneys, exhaust dirty air, and require considerable hourly or daily maintenance. Little has been done in the last 30 years to improve on small furnace designs for home use, and small commercial use.

To improve on these above problems would be a coal fired self-contained heating plant that could be easily and economically located for use by existing homes or buildings, would not require hourly maintenance, would exhaust near clean air, and would produce useable heat at a high efficiency rate.

Such a unit could save the consumer near 80 to 90 percent on the BTU's of heat produced, as compared to the heat bought from Electric Utility Companies. For example, each kilowatt-hour of heat (3412 BTU) bought from Electric Utility Companies in the South would range in cost above 0.04 ½¢and up to near 0.10 ¢in some Northern areas. This same heat cost generated from the above described coal fired heating plant would be approximately 0.01¢per kilowatt-hour, thereby showing a savings of near 80 to 90 percent over the heat bought from Electric Utility Companies. Upon realizing this, I started working toward developing such an apparatus in 1981. My first successful burn in a test furnace was in early 1982, when my 3 inch diameter model furnace burned for one hour on 12 ounces of coal, proving that the burn of coal of selected quality could be controlled to produce the desired heat output, even to under 10,000 BTU per hour. After building three different model furnaces and performing numerous coal burn tests, the design of this enclosed apparatus was developed.

SUMMARY OF THE INVENTION

The purpose of this invention is to provide a system of supplying needed winter heat for existing homes or small buildings in the most economical way, one of which is the burning of coal at a high efficiency rate, with said high efficiency being improved greatly by sizing said unit to deliver the desired heat output from under 10,000 BTU per hour to over 150,000 BTU per hour.

Another purpose of this invention is to clean the exhaust air from said coal burn, thereby preventing any air pollution.

A third purpose is to burn said coal in a convenient manner by reducing hours of dirty maintenance work that most furnace's require. Such is accomplished systems automatic controls, its vertical exhaust pipes, soot and ash storage traps and various self-cleaning features.

Another purpose is to provide hot water and heat storage facilities by using hot water heating methods and storage tanks installed as part of said system. Such hot water can be used for all desired needs including heating the building through hot water to air heat exchangers located in the central duct system in front of blowers, or by use of radiators, or any other type hot water heaters desired. Chillers, which operate from hot water, can be used for summer cooling by storing the chilled water in a separate storage tank and converting the building's heating system to a cooling system.

An additional purpose is to provide a system that can be conveniently located for use by existing homes or buildings. Such is accomplished by the unit being self-contained with chimney, thereby making it easily located inside or outside of the existing selected building.

Various other features of the method and apparatus of the present invention will become obvious to those skilled in the art upon reading the disclosure set forth hereinafter.

BRIEF DESCRIPTION OF THE DRAWINGS

Referring now to the drawings which show the heating plant's design and the sizing of the grate, firebox and combustion areas to produce the desired heat output, and then the added water heating system showing the working parts and water heating parts of one size unit (4 inch diameter firebox and grate), which produces approximately 30,000 BTU per hour of heat.

FIG. A is the view of the size apparatus thar produces 30,000 BTU per hour of heat, showing the locations of the 4 inch grate and firebox and ash dumping system, the gas ignition system and storage area, the electrical control box, the coal and limestone storage ben and the auger feeding system, the forced draft air fan and air heating system, the 4-part chimney system with self-cleaning features, the mechanical soot traps and ash storage areas and the last chimney section containing an exhaust air washing system.

Figure 13:
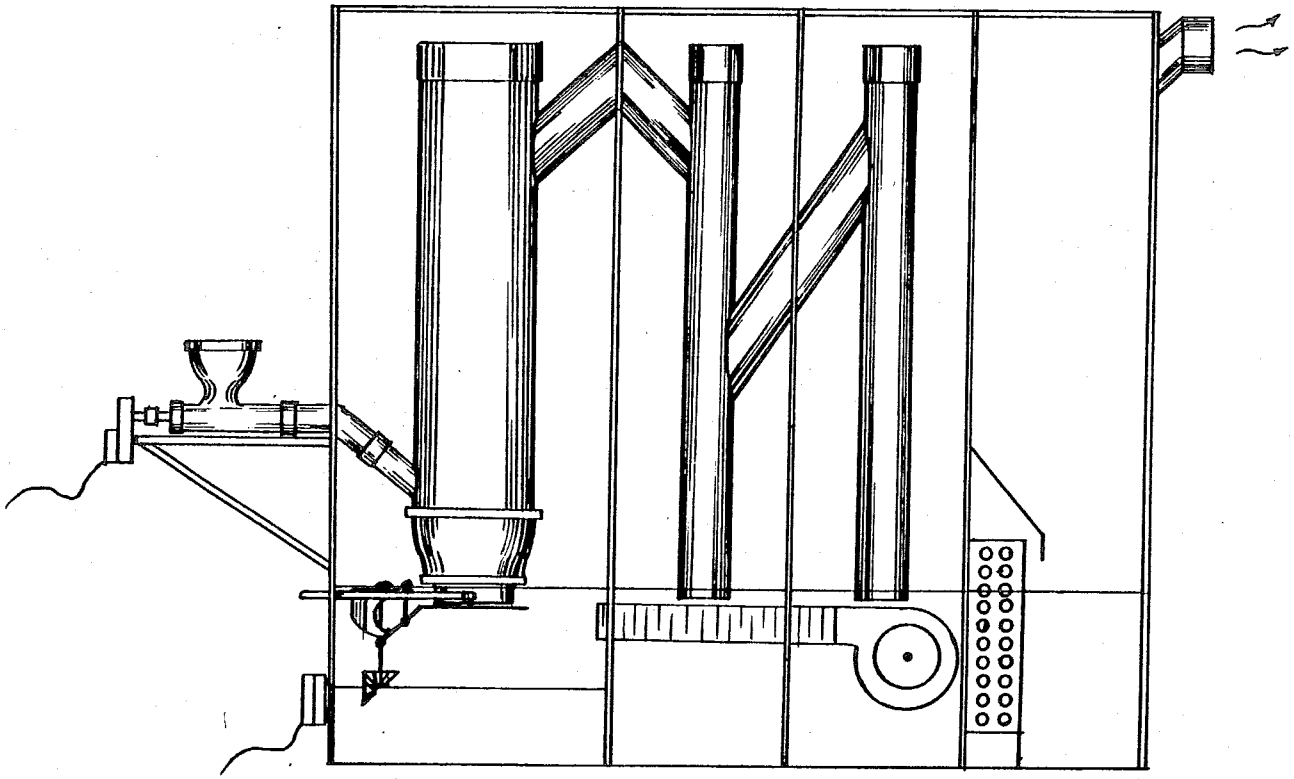

FIG. A-1 is a front angle view of the furnace showing cut-a-ways of various inner parts.

FIG. A-2 is a cut-a-way view of the grate and ash dumping system.

FIG. A-3 is a cut-a-way view of the under side of the grate, the ash dumping system, and gas ignition system.

FIG. A-4 is a view from two sides and top of the air heater and forced draft air fan.

FIG. A-5 is a front angle view of the apparatus showing the added water heating coils and hot water storage tanks, FIG. A-5-1 is a front angle view of the apparatus showing the use of a series of three hot water storage tanks.

FIG. A-6 is an end view of FIG. A-5.

FIG. A-7 is an end view cut-a-way showing the added water heating coils wrapped in gravel to accelerate heat absorption, held in place with wire hardware cloth and surrounded by insulation.

FIG. A-8 is a front angle cut-a-way view of the added water coils wrapped in gravel, held in place with wire hardware cloth and surrounded by insulation.

FIG. A-9 is a top cut-a-way view of the apparatus showing the added system of the water heating coils and hot water storage tank in place, and the water circulating pump that circulates the water from the bottom of the storage tank through the heating coils and back into the top of the tank.

FIG. A-10 is a side view of another chimney section that can be added one or more times between chimney section II and section III, if needed for additional soot traps or additional need of water heating surface, or both.

FIG. A-11 is a view of another chimney section that can be added one or more times to chimney section IV, if additional exhaust air washing is needed.

FIG. A-12 is a front view of the apparatus, as it would appear, located outdoors on a concrete slab, and its insulated metal jacket with its outdoors on a concrete slab, and in it servicing doors.

FIG. B is the view of the sized furnace that produces approximately 70,000 BTU per hour of heat, showing the only change from FIG. A as being the grate and firebox size increased to 6 inches in diameter and the combustion chamber chimney section directly above increased to or beyond the minimum size to contain enough air space to offer good combustion.

FIG. C is the view of the sized furnace that produces approximately 90,000 BTU per hour of heat, showing the only change from FIG. A as being the grate and firebox size increased to 7 inches in diameter and the combustion Chamber chimney section directly above increased to or beyond the minimum size to contain enough air space to offer good combustion.

FIG. D illustrates a view of the furnace exhaust air washing system installed on an existing furnace chimney with water reservoir located below.

FIG. E is a view of the furnace exhaust air washing system installed in the lower side section of an existing furnace chimney with the exhaust air routed through the washing chamber.

FIG. F illustrates a view of the air washing system installed in the attic of a house with the chimney exhaust being routed through said washing chamber and back into the upper part of the chimney to exhaust outside, and the water receiving reservoir located in the base of the air washing chamber.

FIG. G illustrates how the exhaust air washing system can be used in a horizonal position, thus showing its versatility in designs to function also on the exhaust of machines.

DETAIIED DESCRIPTION

Referring to FIG. A, there is illustrated a layout and cut-a-way of the 30,000 BTU per hour of heat output size apparatus. Said apparatus is standing on a concrete slab 22 that is approximately $4\frac{1}{2}$ feet$\times 8\frac{1}{2}$ feet, which is resting on the ground 21. For indoor location, a similar size piece of flat sheet metal would suffice. The frame 23 is made from suitable angle irons bolted or welded together, which makes the frame 23 that supports the various compartments of the apparatus.

FIG. A-1 illustrates the front angle view of said apparatus, or furnace, and the four chimney sections that are supported by frame 23. The base of each chimney section I, II and III are individually enclosed in an air tight metal container with a door on the outer side for future servicing. Chimney section IV has a water tight inner liner and a water reservoir 58 at its base, as shown.

FIGS. A-2 and A-3 illustrates different cut-a-way views of the metal container 31, the base of chimney section I and its contents. A 4 inch diameter round pipe 33 extends approximately 2 inches downward through a tight fitting hole located in the center of the top of said base container 31, and is fastened securely underside. Said pipe 33 has its upper end attached to the 4 inch diameter end of a 6 inch$\times$4 inch bell reducer 32. Extending on upward into chimney section I, from the 6 inch diameter top of the bell reducer 32 is the 6 inch round metal chimney 43, as shown, which extends upward approximately 3 feet and is capped 45 or sealed at its upper end, all of which is the combustion area.

FIGS. A and A-1 show that chimney pipe 43 has welded to it the coal supply pipe 44 and 4 inch diameter pipes 46, with pipes 47, 48, 51, and 52 all being welded together in vertical and semi-vertical positions to form the exhaust system of the furnace, as shown. Pipes 48 and 52 are capped, as shown, by 49 and 53. The bottom end of pipe 48 is inserted approximately one inch through a round tight fitting hole in the center of the top of the metal container 50, at the bottom of chimney section II, and pipe 52 is inserted approximately one inch through a round tight fitting hole in the center of the top of the metal container 54, at the bottom of chimney section III. This creates two mechanical soot traps and storage areas in the metal containers for soot and fly ash to accumulate and to help clean the furnace exhaust air with the help of gravity.

The grate 34, as shown in FIGS. A-2 and A-3, is a flat round metal disc, and is large enough to cover the lower end of the 4 inch diameter round pipe 33 when closed against its lower end, which creates the firebox area. It is vented with many small holes or slits for draft air to pass through. The grate is fastened securely to the metal strip 35, and angled so that it will tightly fit against the lower end of the 4 inch round pipe 33, when closed against it.

Metal strip is hinged at its center by the U-bolt 36. Said U-bolt 36 being securely fastened to the underside top of metal container 31, as shown. The other end of the metal strip 35 has a metal round shaft 37 extending from its side approximately one inch, which contains a sleeve bearing that rests on the under side of the inverted 5 inch diameter metal cup 38. The sides of the metal cup 38 have been cut in a pattern that by rotating said cup 38 will raise and lower metal strip 35 which will open and close grate 34 against the bottom of pipe 33, thus by said rotation can dump any ashes on grate 34 into the bottom of metal container 31, Metal cup 38 is held in place with metal sleeve type braces attached to its axle 39 and to the inside walls of the metal container 31, and rotates on a pivot located in its top center and fastened to the under top of the metal container 31. The metal cup 38 is rotated at desired times through its axle 39, through two angled cog-wheels 40, through the axle 41, and by the electric motor 42, which is controlled by the central electric control timer that is located in the electric control box 6.

FIG. A-3 illustrates the bottled gas ignition, as being an electric glow plug 30-*b* that ignites the gas inside the grate 34 area at torches 30-*c*, as it is turned on electrically by the control timer and as said gas passes through tubes 30-*a* from the storage bottle 29. The number of torches needed to ignite said coal will vary as to feed and furnace size. Crushed coal and limestone mixture is fed onto grate 34 through sloping pipe 44, see FIG. A, that is fed by auger 26, powered by electric motor 27 and supplied from ben 25. By adjusting speed of motor 27, the speed of the auger 26 is adjusted to deliver the desired amount of fuel mixture, approximately $\frac{2}{3}$ ounce per minute, to burn on grate 34 and produce the near 30,000 BTU per hour of heat, or any other desired burn that would be near this amount.

FIGS. A, A-1 and A-4 illustrates that air heater 56 is located in the base of chimney section IV against the wall of chimney section III, and positioned so that the furnace exhaust air will circulate from container 54 into and pass up through heater 56 and exit into chimney section IV. Air fan 55 is located in the upper front corner of tne base of chimney section III and its intake is ducted to air heater 56 so that its intake air will be drawn from the outside through the many horizonal copper tubes 57 in the air heater 56. Said heated air is sent by the air fan 55 through pipe 55-*a* into the air tight metal base 31 of chimney section I, which houses the grate 34, thus creating heated forced draft air through the furnace, being regulated to desired force by regulating the speed of fan 55.

FIGS. A and A-1 show that chimney section IV has a water reservoir in its base and located in its water reservoir is float valve 60 for maintaining a desired water level, and an electric submersible water pump 61, which is surrounded by a filter and when operating pumps water from the basin or reservoir 58, up through pipe 62 into pipe 63, located in the top of chimney section IV, and out through the many small spray holes located in the bottom side of pipe 63, which sprays back into basin 58. Its purpose being to clean the exhaust air from the furnace, as it rises from air heater 56, passes through said mist and spray and exits outside through pipe 65. An auxiliary draft air fan can be located in exit pipe 65, if needed for furnace draft air balance. Also, if additional air washing is needed, FIG. A-11 illustrates how additional sections of air washing units can be installed to produce the needed results.

FIGS. D, E, and F illustrates some of the many ways in which the exhaust air washing system can be installed on other existing chimneys for cleaning said exhaust air of pollutants. Any chemicals that would improve the cleaning performance of said air washing system can be added to the reservoir water. For example sodium bicarbonate would eliminate all acids in the furnace exhaust air, and prevent any contribution toward acid rain.

FIGS. A-5 and A-9 illustrate the addition of a hot water heating system by showing the location of the hot water storage tanks 67 and 67-*a* inside and at the top of the heating plant. The location helps to improve the natural flow of heated water, as it rises to the top. Water pipe 66 represents the outside water supply line that feeds the water storage tanks shown in FIG. A-9. FIG. A-1 shows the water supply continuing through the bottom of basin 58 in a coil pattern. Its purpose is to absorb and deliver into the bottom of tank 67-*a* any needed water along with any available heat that might be accumulating in said water 59 in basin 58, as it spray washes the furnace exhaust air.

Water tank 67*a* has a connecting water fro its top to the coils 66, located in the bottom of basin 58, which allows heated water that accumulates in coils 66 to have a natural flow back into said water tank 67-*a*. Said water leaves tank 67-*a* from it s top and enters the bottom of tank 67 as needed, which passes on out of the top of tank 67 when used by the consumer. Water supply pipe 66 can enter furnace unit from underground, if needed to prevent winter freezing.

FIG. A-5 illustrate the front angle view of the water coil heating pipes 68, that coils through the three chimney sections of the furnace. The water leaves the bottom of the storage tank 67 by use of water circulating pump 68*a*, as shown in FIGS. A-5 and A-9, and enters the pipe header located at the base of the three chimney sections I, II and III, then circulates up through the coil water pipes 68 that are wrapped around the three exhaust chimneys located in the three chimney sections, then enters the water pipe header located at the top of the three chimney sections and then re-enters the top of water tank 67.

FIGS. A-7, A-8 and A-9 illustrate the cut-a-way view of the above described coil pipe 68 and how the three chimney sections I, II and III are each surrounded and separated by insulation 71. This insulation 71 separates the heating sections of the furnace into three different individual compartment chambers, with section I producing the most heat, section II producing less heat than section I and section III producing still less heat than section II. This compartmental step down in heat production per chimney section chamber allows, if needed to obtain a higher efficiency in heat absorption, the opportunity of using a series of water storage tanks, as shown in FIG. A-5-1, one water tank per chimney section, and connected in series so that the coolest chimney section would be heating the coolest outside water supplied and the last water tank of the series connected to and heated by the hottest chimney section, which would supply the consumer. If additional chimney sections are needed, FIG. A-10 illustrate how more can be added between section II and section III.

FIGS. A-7, A-8 and A-9 illustrate the gravel that is wrapped around the heating coils 68 and held in place by wire hardware cloth 69. Said gravel 70 acts as a heat absorbing sponge by absorbing and holding heat around the coils 68, thereby accelerating and creating higher efficiency in heat absorption.

The system of using said furnace to heat water is energized through the operation of the electrically driven timer and its thermostats. The thermostat 68-*b* located at the top of the water storage tank, shown in FIGS. A-5 and A-9, energizes the electric timer, located in box 6 of the apparatus, when the water temperature in said tank is below a pre-set degree, thereby causing the furnace to start a burn cycle.

The timer, located in control box 6, see FIG. A, starts electric motor 42, and as said motor rotates at a speed of one revolution per minute, it opens Grate 34, see FIG. A-2, thereby emptying all ashes from the previous burn into the bottom of base 31, of chimney section I, which is large enough to store several days of ashes, and then closes grate 34 back against the bottom end of pipe 33, at which time motor 42 cuts itself off by a 3-way switch located on its shaft.

Next the electric circuit of the ignition system is energized by the timer. The glow plug 30*b* , see FIG. A-3, is turned on and simultaneously the gas valve 30, see FIG. A, is opened which releases gas from bottle 29 to torches 30*c*, which can vary in number and location as to furnace size, and said gas is ignited by the glow plug. Each gas torch is located in a fixed position so that its lighted flame will ignite the other torch. With electric draft air heater 55*b*, see FIG. A, being on this same electric circuit, it too is energized along with said glow plug and gas torches. Thermostat 32-*a*, see FIG. A-2, is located against the base of bell reducer 32 and controls the length of time this ignition circuit is on.

With ignition system on and gas torches 30-*c* burning, the timer then turns on electric motor 27 at a pre-set speed which turns auger 26, thereby starting the feed of coal and limestone mixture from ben 25 through pipe 44 onto grate 34, see FIG. A. By adjusting speed of motor 27, the speed of auger 26 delivers to grate 34 the fuel feed that produces the desired BTU output of heat. The timer now simultaneously turns on the electric draft fan 55 at a pre-set speed, see FIG. A, the air washing water pump 61, and the water circulating pump 68-*a*, see FIGS. A-5 and A-9. With electric draft air heater 55-*b* having been turned on only moments before with the ignition system, said draft air fan 55 begins to deliver heated draft air to the base 31, chimney section I, and as said base 31 is air tight, the hot draft air is forced up through the many holes in grate 34 and supplies the needed air for combustion and helps gas torches ignite said coal.

As coal mixture begins to ignite and burn, usually in 4 to 5 minutes, the heat produced will heat bell reducer 32 and cause the thermostat 32-*a* to rise in temperature, see FIG. A-2, past the height of a pre-set degree, thereby disconnecting the electrical circuit of the gas ignition system. This closes gas valve 30, which cuts off the gas to torches 30-*c*, turns off glow plug 30-*b*, and turns off electric draft air heater 55-*b*. As ignition of coal has now been completed, heat from the burning coal is now heating draft air heater 56, see FIG. A, and is heating draft air that fan 55 is drawing from the outside through said air heater and feeding the furnace.

The furnace is now operating solely on the burn of the coal mixture from ben 25, FIG. A. The feed of coal to grate 34, by electric motor 27, continues with forced draft air fan 55 drawing outside air through the many parallel hot copper tubes in air heater 56, and feeding said heated air to the base 31, chimney section I. Said air being used by the furnace for the combustion of the coal feed, with air continuing up through pipe 43, chimney section I, then continuing through connecting pipes 46 and 47 into chimney section II, down through pipe 48, then abruptly turning back up through connecting pipe 51, thereby forcing by gravity most of the fly ash and soot to fall into the base 50, chimney section II, which has a capacity of storing several days of collection. Said air continues on up and into pipe 52, chimney section III, then down through said pipe 52 into the base 54 of section III, leaving any additional soot in said base 54, and exits into the base of air heater 56, traveling up through and around the many copper tubes located in air heater 56 and heating them, thereby heating the outside air that the draft fan 55 draws through them from the outside. Said furnace air then exhausts the air heater 56 from the top side into the air washing spray in chimney section IV, continuing up through the water mist and spray and exhausts to the outside by exhaust pipe 65, An induced draft air fan is located in exhaust pipe 65 to be used, if needed, for furnace draft balance.

As heat is produced by the coal burn, most of it passes through the walls of the exhaust pipes that are surrounded by the spiral water coils, see FIG. A-5, and as each chimney section is well insulated and as said coils are wrapped in gravel, see FIG. A-8 and A-9, heat absorption by said water circulating through said coils is increased, thus increasing the efficiency of heat storage in the water tank 67.

Any left over heat that is not absorbed by the water coils and exits chimney section III, is used to heat the many copper tubes in air heater 56, see FIG. A. If by chance the air that exhaust from air heater 56 into chimney section IV still contains heat, the water spray will absorb this left over heat, as it falls and delivers said heat into the basin of water at the bottom, which is then absorbed by the water coils 66, see FIG. A-1, which is the outside water supply to the water heater storage tank 67*a*, thus transferring said heat into said water tank.

With chimney section IV being well insulated and having a water tight liner and a water reservoir in its base, the water leveling valve and float 60, see FIG. A-1, maintains said basin of water to the desired depth, usually about 8 to 10 inches. Submersible water pump 61, surrounded by filters and located in the top of section IV, see FIG. A-1, and sprays said water out through many small holes located on the under side of pipe 63, which falls in a mist and rain back down into the basin, thereby cleaning the furnace exhaust air of pollutants, as it rises by forced and/or induced draft from the air heater 56 up through said spray of water and exhausts out pipe 65 to the outside. Any heat in said furnace exhaust air is absorbed by the water spray, as it falls, thus accumulating in the water in the basin 58, which is then transferred into the water storage tank 67*a* by water coils 66, as described above. Outside water supply pipe 66 could enter furnace from under ground, if needed to prevent winter freezing. Also, additional exhaust air washing spray systems can be added like that shown in FIG. A-11, if needed for the furnace to exhaust clean air.

As the burn continues, heat is continually stored in water tank 67, see FIG. A-9, by the circulating water that exits the bottom of said tank, circulates up through the heating coils and back into the top of said tank, until such time that thermostat 68*c*, located near the bottom of said water storage tank signals the timer in box 6 that the temperature of the hot water in the bottom of said tank or tanks has reached a pre-set degree, thereby causing the timer to advance to the end of the coal burn cycle, and cut off motor 27 that is feeding coal to grate 34. Then after approximately five minutes and the fire having burned out on grate 34, said timer then turns off water circulating pump 68*a*, exhaust air washing water pump 61, and forced draft air fan 55, thereby closing down the furnace and completing the burn cycle. Said furnace remains off until the hot water stored in the tank or tanks is used and cooled to the pre-set degree in the top of the tank that will cause thermostat 68*b*, located at the top of the tank, to signal to the timer in box 6 to begin another burn cycle.

It is to be understood that the foregoing drawings and description of the invention is to be taken as a preferred embodiment and that various other modifications will occur to those skilled in the art upon reading the disclosure, however all changes and modifications that come within the spirit of the invention are desired to be protected.

I claim:

1. The method of burning a fixed amount of coal or fuel per hour in a near clean fashion with minimum maintenance and extracting and storing near all the heat produced, comprising the steps of a. constructing a flat sized base of concrete or of other suitable material, b. constructing a support frame on said base, c. constructing an air tight box, having a top surface and having a side door for servicing, d. installing the end of a selected size vertically positioned metal pipe down through the top surface of the air tight box, e. installing a sized flat perforated metal grate in said box against the lower end of said vertical pipe, thus creating a firebox area, with said grate having means for moving away from the lower end of the pipe and returning to the original position, by use of an electric motor, axles, and cog-wheels, thus providing means for dumping ashes from grate area by use of electric current, f. locating a source of combustible gas with conduit means for supplyiny combustible gas to the firebox areea, control means in the conduit for releasing the gas, and ignition means for igniting the gas at the grate, g. locating a thermostat on the outer wall of the pipe for sensing the temperature thereof and controlling the ignition, h. attaching the lower end of a selected size vertical positioned metal pipe, with capped upper end, to the larger end of a metal bell reducer and attaching the smaller end of the bell reducer to the upper end of said firebox pipe protruding out of the top of the air tight box, said size to contain sufficient air volume to offer good combustion of the fixed amount of fuel to be burned per hour, i. installing a feed pipe connecting the fuel storage area to the firebox area with means of delivering said fuel to the firebox by use of auger powered by a variable speed electric motor, j. installing at least two exhaust air pipes, with capped upper ends, positioned vertically and parallel to the vertical pipe, connecting the vertical pipe and the exhaust air pipes in series with connecting pipe sections, being semi-vertical, and inserting the lower end of each vertical exhaust air pipe into the top of an air tight box, having a side door for servicing, to provide the furnace with soot and fly ash traps, k. locating a forced draft fan at the box most remote from the combustion chamber with means of delivering its output into the air tight box containing the grate, said means containing an electric air heater, which is controlled by the electric circuit controlling the gas ignition system, l. installing an air heater positioned near the box most remote from the combustion chamber, having connecting means for allowing furnace hot exhaust air to pass up through said air heater and heat the many horizonal parallel tubes that are suspended through said heater with said tubes providing connecting means with draft fan allowing outside air a passage way through the air heater and through draft fan into air tight box containing grate, thus providing heated draft air for furnace, m. installing at least one air washing chamber having connecting means with air heater, or furnace exhaust, to allow furnace exhaust air to pass through said washing chamber and exit outside through exhaust means that contain an inducted draft fan, said washing chamber having a water reservoir, a water float valve, a circulating water pump with filters and connecting means with a water spray head located at its inside top and an outside water supply pipe coiled through its reservoir, all providing a system for washing the furnace exhaust air, n. installing at least one water storage tank near the top of the furnace exhaust air pipes with outside water supplied through connecting means with pipe coils located in the reservoir of the air washing chamber, o. locating water heat pipes against the furnace vertical pipe and exhaust air pipes with means of circulating water from the bottom of the storage tank through said heat pipes and back into the top of the storage tank, thus providing means of delivering furnace heat into said water tank, p. covering the water heat pipes with gravel and holding said gravel in place by means of hardware cloth and surrounding each vertical section with a layer of insulation, q. installing a water discharge pipe in the water storage tank for consumer connection means, r. installing at least one hot water thermostat and control timer positioned to furnish means of operating the furnace unit automatically, s. placing an insulated cover over said furnace unit with appropriate servicing doors and utility connection means.

2. An apparatus for burning a fixed amount of coal or fuel per hour in a near clean fashion with minimum maintenance and extracting and storing near all the heat produced, comprising a. a base made of concrete, a flat piece of metal or of other suitable material, b. a support frame on said base, c. an air tight metal box, having a top surface and having a side door for servicing, located on the base, d. a selected size vertically positioned pipe extending through the top surface of the box, e. a sized flat perforated metal grate disposed against the lower end of the vertical pipe in the box, providing a firebox area, means of moving the grate away from the lower end of the pipe and returning to the original position by use of an electric motor, axles and cog-wheels, f. a source of combustible gas, conduit means for conducting the combustible gas to a point adjacent to the grate, control means in the conduit for releasing the gas, ignition means for igniting the gas at the grate, g. a thermostat on the outer wall of the pipe for sensing the temperature thereof and controlling the ignition, h. a selected size vertical positioned metal pipe, with capped upper end, its lower end attached to the larger end of a metal bell reducer with the small end of the bell reducer attached to the upper end of the said firebox pipe protruding out of the top of the air tight box, said size containing sufficient air volume to offer good combustion of the fixed amount of fuel to be burned per hour, i. a feed pipe connecting the fuel storage area to the firebox area with means for delivering the fuel to the firebox, by use of an auger powered by a variable speed electric motor, j. at least two chimney exhaust air pipes, with capped upper ends, positioned vertically and parallel to the vertical pipe, the vertical pipe and the exhaust air pipes are connected in series by connecting pipe sections, which ar semi-vertical, said vertical exhaust air pipes each having a lower end inserted in the top of an air tight metal box, having a side door for servicing, providing the furnace with soot and fly ash traps, k. a forced draft fan positioned at the box most remote from the combustion chamber having means of delivering its output into the air tight box containing the grate, said means containing an electric air heater, l. an air heater positioned near the box most remote from the combustion chamber and having connecting means for allowing the furnace hot exhaust air to pass up through said air heater and heat the many horizontal parallel tubes that are suspended through said heater with said tubes providing connecting means with draft fan allowing the outside air a passage way through air heater and through draft fan into the air tight box containing the grate, m. at least one air washing chamber having connecting means with air heater, or furnace exhaust, to allow the furnace exhaust air to pass through said washing chamber and exit outside through exhaust means that contain an induced draft fan, said chamber having a water reservoir, a water float valve, a circulation water pump with filters and connecting means with a water spray head that is located at its inside top, and an outside water supply pipe coiled through its reservoir, n. at least one water storage tank positioned near the top of the furnace exhaust air pipes, with outside water supplied through connecting means with pipe coils located in the reservoir of air washing chamber, o. water heat pipes positioned against the furnace vertical pipe and exhaust air pipes with means of circulating water from the storage tank through said water heat pipes and back into storage tank, thus delivering the furnace heat into the water tank, p. said water heat pipes being covered with gravel with said gravel held in place by means of hardware cloth with each vertical section being surrounded by a layer of insulation, q. a water discharge pipe in the storage tank for consumer connection means, r. at least one hot water thermostat and a control timer positioned to furnish means of operating the furnace unit automatically, s. an insulated cover over said furnace unit wih appropriate servicing doors and utility connection means.

3. A method of transferring heat into water storage tanks from a pipe type furnace burning a fixed amount of coal or fuel per hour to produce a fixed amount of heat per hour, comprising the steps of a. locating on a suitable flat surface a selected air tight metal box, having a top surface and having a side door for servicing, b. selecting a particular size metal pipe for use as a firebox determined by the fixed amount of coal or fuel burn per hour, c. inserting one end of the selected size vertically positioned metal pipe down through the top surface of the air tight box, d. attaching through mechanical means a sized near flat perforated metal grate against the lower end of said vertical metal pipe inside said box, thus creating a firebox area, e. attaching the small end of a selected size metal funnel-shaped bell reducer to the upper end of said firebox pipe that protrudes up out of the top of said air tight box, f. attaching the lower end of a selected size vertically positioned metal pipe to the upper larger end of the bell reducer, with said vertical pipe size containing, with said bell reducer and firebox area, sufficient air volume to offer good combustion of the fixed amount of fuel to be burned per hour, g. enclosing the upper end of said vertical pipe, h. installing a forced draft fan positioned with means of delivering it output into the air tight box containing the grate, i. locating at least two chimney exhaust air thin walled metal pipes, with capped upper ends, positioned vertically and parallel to the combustion chamber vertical pipe, all connected in series with connecting pipe sectional, being semi-vertical, thus forming a chimney for the furnace exhaust air, j. installing said semi-vertical connecting pipe section to connect the first positioned vertical exhaust air pipe to the combustion chamber verticle pipe, k. inserting the lower end of said first positoned vertical exhaust air pipe into the top of an air tight metal box, having a side door for servicing, thus providing a soot and fly ash trap, l. installing the second vertical positioned thin wall metal exhaust air pipe parallel to the first and inserting its lower end into the top of a second air tight box, having a side door for servicing, thus providing a second soot and fly ash trap, m. installing a semi-vertical exhaust air pipe section connecting the first positioned vertical exhaust air pipe to the second positioned vertical exhaust air pipe, n. installing an exhaust air pipe between the air tight box most remote from the firebox area, and the outside, to serve as a furnace exhaust to the outside, o. installing in said outside exhaust pipe an auxiliary air fan for induced draft air, p. locating coal or fuel storage means near the firebox area and connecting same to a fuel feed pipe containing a sized auger powered by a variable speed electric motor with said feed pipe also connected to the firebox area, thus supplying means of delivering said fuel to the firebox, q. locating at least one water storage tank near the top of the furnace and connecting same to an outside water supply line, r. installing water heat pipes in coils around each furnace vertical exhaust air pipe and around the combustion chamber vertical pipe, s. connecting the bottom of the water storage tank to the base of the coiled heat pipes and connecting the coiled heat pipes at the top of the furnace exhaust air pipes to the top of said water storage tank, and providing means of circulating water from the bottom of the water storage tank, through the coiled heat pipes and bak into the top of the storage tank for delivering furnace heat into said water tank, t. covering the water heat pipes with gravel, u. holding said gravel in place by means of hardware cloth, v. surrounding each vertical section of the furnace with insulation, w. installing a water discharge pipe in the water tank for consumer connection means, x. installing at least one appropriate thermostat switch positioned to furnish means of controlling the furnace burn cycle.

4. An apparatus for transferring heat into water storage tanks from a pipe type furnace burning a fixed amount of coal or fuel per hour to produce a fixed amount of heat per hour, comprising a. a selected air tight metal box, having a top surface and having a side door for servicing, located on a suitable flat surface, b. a particular size metal pipe for use as a firebox, the size being determined by the fixed amount of coal or fuel burn per hour, c. said selected size vertically positioned metal pipe having its lower end inserted down through the top surface of the air tight box, d. a sized near flat perforated metal grate attached through mechanical means against the lower end of said vertical metal pipe inside said box, thus creating the firebox area, e. a selected size metal funnel-shaped bell reducer with its small end attached to the upper end of said firebox pipe that protrudes up out of at the top of said metal air tight box, f. a selected size vertically positioned metal pipe with its lower end attached to the upper larger end of the bell reducer, said pipe size containing, with said bell reducer and firebox area, sufficient air volume to offer good combustion of the fixed amount of fuel to be burned per hour, g. said vertical pipe having its upper end enclosed or capped, h. a forced draft fan positioned with means of delivering its output into the air tight box containing the grate, i. at least two chimney exhaust air thin walled metal pipes, with capped upper ends, positioned vertically and parallel to the combustion chamber vertical pipe, all connected in series with connecting pipe sections, being semi-vertical, which form a chimney for the furnace exhaust air, j. said first positioned vertical exhaust air pipe connected to the combustion chamber vertical pipe by a semi-vertical connecting pipe section, k. said first positioned vertical exhaust air pipe having its lower end inserted into the top of an air tight metal box, with a side door for servicing, providing a soot and fly ash trap, l. a second vertical exhaust air pipe positioned parallel to the first and its lower end inserted into the top of a second air tight box, having a side door for servicing, which provides a second soot and fly ash trap, m. a semi-vertical exhaust air pipe section connecting the first positioned vertical exhaust air pipe to the second positioned vertical exhaust air pipe, n. an exhaust air pipe connecting the air tight box most remote from the firebox area, to the outside, to serve as a furnace exhaust to the outside, o. an auxiliary air fan for induced draft air installed in said outside exhaust pipe, p. coal or fuel storage means located near the firebox area connected to a fuel feed pipe containing a sized auger, powered by a variable speed electric motor, with said feed pipe connected to the firebox area, thus supplying means of delivering said fuel to the firebox, q. at least one water storage tank located near the top of the furnace and connected to an outside water supply line, r. water heat pipes coiled around each furnace vertical exhaust air pipe and arond the combustion chamber vertical pipe, s. said water storage tank having its bottom connected to the base of the coiled heat pipes and the coiled heat pipes at the top of the furnace exhaust air pipes connected to the top of said water storage tank with means provided for circulating water from the bottom of the water storage tank, through the coiled heat pipes and back into the top of the storage tank, thus delivering furnace heat into said water tank, t. the water heat pipes covered with gravel, u. said gravel held in place by means of hardware cloth, v. each vertical section of the furnace surrounded with insulation, w. a water discharge pipe in the water tank for consumer connection means, x. at least one appropriate thermostat switch positioned to furnish means of controlling the furnace burn cycle.

5. A method of creating the fixed amount of heat per hour from burning a fixed amount of coal or fuel per hour and extracting near all of said heat from the furnace and furnace exhaust air through exhaust pipe walls comprising the steps of a. having a selected flat suitable surface, b. having a selected air tight metal box, with a top surface and with a side door for servicing, c. selecting a particular size pipe for use as a firebox determined by the fixed amount of coal or fuel burn per hour, d. inserting one end of the selected size vertically positioned metal pipe down through the top surface of air tight box, e. attaching through mechanical means a sized near flat perforated metal grate against the lower end of said vertical metal pipe inside said box, thus creating a firebox area, f. attaching the small end of a selected size metal funnel-shaped bell reducer to the upper end of said firebox pipe that protrudes up out of the top of said air tight box, g. attaching the lower end of a selected size vertically positioned metal pipe to the upper larger end of the bell reducer with said vertical pipe size containing, with said bell reducer and firebox area, sufficient air volume to offer good combustion of the fixed amount of fuel to be burned per hour, h. enclosing the upper end of said vertical pipe, i. installing a forced draft fan positioned with means of delivering its output into the air tight box containing the grate, j. locating at least two chimney exhaust air thin walled metal pipes, with capped upper ends, positioned vertically and parallel to the combustion chamber vertical pipe, all connected in series, with connecting pipe sections, being semi-vertical, thus forming a chimney for the furnace exhaust air, k. installing said semi-vertical connecting pipe section to connect the first positioned vertical exhaust air pipe to the combustion chamber vertical pipe, l. inserting the lower end of said first positioned vertical exhaust air pipe into the top of an air tight metal box, having a side door for servicing, thus providing a soot and fly ash trap, m. installing the second vertical positioned thin wall metal exhaust air pipe parallel to the first and inserting its lower end into the top of a second air tight box, having a side door for servicing, thus providing a second soot and fly ash trap, n. installing a semi-vertical exhaust air pipe section connecting the first positioned vertical exhaust air pipe to the second positioned vertical exhaust air pipe, o. installing an exhaust air pipe between the air tight box most remote from the firebox area, and the outside, to serve as a furnace exhaust to the outside, p. installing in said outside exhaust pipe an auxiliary air fan for induced draft air, q. locating coal or fuel storage means near the firebox area connecting same to a fuel feed pipe containing a sized auger powered by a variable speed electric motor with said feed pipe connected to the firebox area, thus supplying means of delivering said fuel to the firebox.

6. An apparatus for producing the fixed amount of heat per hour from burning a fixed amount of coal or fuel per hour and extracting near all of said heat from the furnacee and its exhaust air through exhaust pipe walls, comprising a. a selected flat suitable surface, b. a selected air tight metal box, having a top surface and having a side door for servicing, c. a particular size metal pipe for use as a firebox, determined by the fixed amount of coal or fuel burn per hour, amount of coal or fuel burn per hour, d. one end of the selected size vertically positioned metal pipe inserted down through the top surface of the air tight box, e. a sized near flat perforated metal grate attached through mechanical means against the lower end of said vertical metal pipe inside said box, thus creating a firebox area, f. a selected size metal funnel-shaped bell reducer with its small end attached to the upper end of said firebox pipe that protrudes up out of the top of said air tight box, g. a selected size vertically positioned metal pipe with its lower end attached to the upper larger end of the bell reducer, said pipe size containing, with said bell reducer and firebox area, sufficient air volume to offer good combustion of the fixed amount of fuel to be burned per hour, h. said vertical pipe having its upper end enclosed or capped, i. a forced draft fan positioned with means of delivering its output into the air tight box containing the grate, j. at 1east two chimney exhaust air thin wall metal pipes, with capped upper ends, positioned vertically and parallel to the combustion chamber vertical pipe, all connected in series with connecting pipe sections, being serm-vertical, which form a chimney for the furnace exhaust air, k. said first positioned vertical exhaust air pipe, connected to the combustion chamber vertical pipe by a semi-vertical connecting pipe section, l. said first positioned vertical exhaust air pipe, having its lower end inserted into the top of an air tight metal box, with a side door for servicing, providing a soot and fly ash trap, m. a second vertical exhaust air pipe positioned parallel to the first and its lower end inserted into the top of second air tight box, having a side door for servicing, which provides a second soot and fly ash trap, n. a semi-vertical exhaust air pipe section connecting the first vertical exhaust air pipe to the second vertical exhaust air pipe, o. an exhaust air pipe connecting the air tight box most remote from the firebox area, to the outside, to serve as a furnace exhaust to the outside, p. an auxiliary air fan for induced draft air installed in said outside exhaust pipe, q. coal or fuel storage means located near the firebox area connected to a fuel feed pipe containing a sized auger, powered aby a variable speed electric motor, with said feed pipe connected to the firebox area, thus supplying means of delivering said fuel to the firebox.

* * * * *